US008654924B2

(12) United States Patent
Behling

(10) Patent No.: US 8,654,924 B2
(45) Date of Patent: Feb. 18, 2014

(54) X-RAY TUBE WITH TARGET TEMPERATURE SENSOR

(75) Inventor: Rolf Karl Otto Behling, Norderstedt (DE)

(73) Assignee: Koninklijke Philips N.V., Eindhoven (NL)

( * ) Notice: Subject to any disclaimer, the term of this patent is extended or adjusted under 35 U.S.C. 154(b) by 284 days.

(21) Appl. No.: 13/131,035

(22) PCT Filed: Nov. 19, 2009

(86) PCT No.: PCT/IB2009/055174
§ 371 (c)(1),
(2), (4) Date: May 25, 2011

(87) PCT Pub. No.: WO2010/061325
PCT Pub. Date: Jun. 3, 2010

(65) Prior Publication Data

US 2011/0222662 A1 Sep. 15, 2011

(30) Foreign Application Priority Data

Nov. 25, 2008 (EP) ..... 08169876

(51) Int. Cl.
*H01J 35/04* (2006.01)
*H05G 1/36* (2006.01)

(52) U.S. Cl.
USPC ..... 378/91; 378/121

(58) Field of Classification Search
USPC ..... 378/91, 121, 119, 142, 143, 144
See application file for complete search history.

(56) References Cited

U.S. PATENT DOCUMENTS

| | | | |
|---|---|---|---|
| 3,836,805 | A | 9/1974 | Kok |
| 4,675,892 | A | 6/1987 | Plessis et al. |
| 4,918,714 | A | 4/1990 | Adamski et al. |
| 2004/0227928 | A1 | 11/2004 | Bonne et al. |
| 2006/0233297 | A1 | 10/2006 | Ishiyama |

FOREIGN PATENT DOCUMENTS

| | | | |
|---|---|---|---|
| DE | 1137145 | | 9/1962 |
| DE | 2312336 | A1 | 9/1974 |
| DE | 4134126 | A1 | 4/1993 |
| EP | 0420108 | A1 | 9/1990 |
| FR | 978570 | | 4/1951 |
| WO | 2007110797 | A1 | 10/2007 |

*Primary Examiner* — Irakli Kiknadze

(57) ABSTRACT

An X-ray tube including a target adapted for generating X-rays upon impact of an electron beam on a focal spot, and a further electrode. The further electrode is arranged and adapted for measuring thermo ionic electron emission from the target. The X-ray tube is adapted for providing a signal relating to a temperature of the target based on thermo ionic electron emission measured by the further electrode.

15 Claims, 5 Drawing Sheets

X-RAY TUBE WITH TARGET TEMPERATURE SENSOR

FIELD OF THE INVENTION

The invention relates to an X-ray tube as well as a medical device comprising such X-ray tube, a program element and a computer readable medium for controlling such X-ray tube. Particularly, the invention relates to an X-ray tube comprising a target temperature sensor.

BACKGROUND OF THE INVENTION

X-ray tubes are for example used in CT systems wherein the X-ray tube is rotating about a patient, generating a fan-beam of X-rays, wherein opposite to the X-ray tube and with it on a gantry rotor rotates a detector system which converts the detected X-rays into electrical signals. Based on these electrical signals, a computer system may reconstruct an image of the patient's body.

In the X-ray tube, a beam of primary electrons emitted from a cathode hits a focal spot of a target and creates X-rays. Therein, a major part of incident electron energy is converted into heat.

Current high-power X-ray tubes might often operate at their material related limits. Especially the target may be constantly under the risk of damaging caused by excessive heat.

In order to prevent damaging of the target and the X-ray tube in general, it may be beneficial to constantly monitor the temperature of the target. Such monitoring will aid in the protection of the patient, the radiologist and the imaging apparatus.

Some conventional tube designs are adapted to measure the temperature of the target by means of e.g. thermal radiation detectors or infra-red light detectors.

However, such measurement techniques may be complex in construction and expensive. Moreover, it may be difficult to get a robust signal, especially in an electrically noisy environment, or when the quality of optical elements like glass windows deteriorate due to vapor deposition in the course of the tube life.

SUMMARY OF THE INVENTION

There may be a need to provide an X-ray tube which at least partially overcomes the above-mentioned problems. Particularly, there may be a need to provide an X-ray tube wherein a temperature of the target may be effectively measured. Furthermore, there may be a need to provide an X-ray tube which is simple in construction thereby reducing manufacturing and maintenance costs.

These needs may be met by the subject matter according to the independent claims. Advantageous embodiments of the present invention are described in the dependent claims.

According to a first aspect of the present invention, an X-ray tube is provided, the X-ray tube comprising a target adapted for generating X-rays upon impact of an electron beam on a focal spot, and a further electrode. Therein, the further electrode is arranged and adapted for measuring thermo ionic electron emission from the heated target.

In may be seen as a gist of the first aspect of the present invention to provide an X-ray tube which is adapted to indirectly measure a local temperature of a target. The X-ray tube may therefore be adapted to measure electrons by means of an additional electrode, wherein the electrons may be thermally emitted from a target due to the effect of thermo ionic electron emission when the target is bombarded with an electron beam in order to generate X-ray radiation.

In other words, the first aspect of the present invention may be seen as based on the idea to provide an X-ray tube which is adapted to measure the temperature of e.g. a target indirectly by measuring electrons which are emitted from the target due to the effect of thermo ionic electron emission. As the thermal emission of electrons from the target per se may depend on the temperature of the target, the temperature of the target may be derived from an electron flow detected by the further electrode.

The X-ray tube according to the invention may be used in a conventional X-ray apparatus, in a computed tomography system or any other apparatus, system or device requiring an X-ray tube.

The X-ray tube according to the invention may be used in hospital or medical practice as well as for non-destructive testing.

In the following, possible details, features and advantages of the X-ray tube according to the first aspect of the invention will be explained in detail.

The X-ray tube may be an anode grounded tube, which means that the anode comprised in the X-ray tube may be grounded, whereas a negative high voltage may be applied to the cathode. The negative high voltage may preferably range from −40 kV to −150 kV.

The term "electron beam" may signify a plurality of electrons which may be generated e.g. by a hot cathode for producing electrons inside an X-ray tube. These electrons may be accelerated towards e.g. an anode due to a potential difference between the hot cathode and the anode.

A target may be placed such that the accelerated electrons impact onto the target.

The target may usually be a solid body comprising or coated with target material such as e.g. tungsten. The target may be rotating. The target and the anode may be one and the same device and is then usually referred to as target anode. However, it may be possible to have a separate anode and a separate target.

The electron beam may impact onto the target at the focal spot. The term "focal spot" may signify the specific area of the surface of the target that is bombarded by a focused electron beam when the X-ray tube is in operation. At the focal spot, the beam usually has the highest concentrated power level. Therefore, at the focal spot, the target may be heated up strongly up to temperatures well above 2000° C.

In case of a rotating target, the focal spot may be located at a fringe of the target. Due to the rotation, the heat from the focal spot caused by the impacting electron beam may be dispersed over the whole fringe of the target.

Due to the interaction of the electrons with the target material, X-rays may be generated. Moreover, electrons may be emitted from the target due to the effect of thermo ionic electron emission, particularly in regions close to the focal spot having high temperatures exceeding e.g. 1900° C. Furthermore, recoil electrons or backscattered electrons may be emitted from the target, particularly at or in a direct proximity of the focal spot.

Preferably, electrons emitted due to the effect of thermo ionic electron emission may be detected by the further electrode. Therein, the thermo ionic emission rate of electrons may strongly depend on the target's temperature, for example increasing exponentially with increasing target temperature.

The further electrode may be a simple wire or plate, e.g. consisting of an electrically conducting material such as a metal. The further electrode may be arranged at a location within the X-ray tube such that electrons emitted from the target may impact onto the further electrode.

According to an embodiment of the present invention, the X-ray tube is adapted for providing a signal relating to a temperature of the target based on thermo ionic electron emission measured by the further electrode.

The thermo ionic electron emission rate may strongly depend on a target's local temperature. Therefore, at a higher temperature of the target, more electrons may be emitted than at a lower temperature of the target. The flow of electrons detected by the further electrode may represent a signal which may provide information about the local temperature of the target.

According to an embodiment of the present invention, the further electrode is at least part time on positive electrical potential with respect to an electrical potential of the target.

For a detection of electrons emitted from the target using the further electrode it may be advantageous that the further electrode may have a positive electrical potential in relation to the target. A positive potential of the further electrode in relation to the target may be reached by applying an electrical voltage between the target and the further electrode. Then, the further electrode may attract the negatively charged electrons which are emitted from the target. Accordingly, also electrons which originally are not emitted into a direction towards the further electrode may be deflected and attracted by the further electrode in order to finally be captured by the further electrode thereby contributing to a measurement signal.

According to an embodiment of the present invention, the further electrode is arranged at a position and in a distance to the target such that, during operation of the X-ray tube and the further electrode having a positive potential with respect to an electrical potential of the target, the further electrode captures electrons emitted from a hot area in a neighbourhood to the focal spot.

Due to the presence of backscattered electrons at the focal spot and/or due to other technical circumstances, the electrons emitted from the target due to the effect of thermo ionic electron emission may not be detected by the further electrode directly at the focal spot. According to that, the further electrode may be placed adjacent to a hot area, e.g. the focal spot track, at a short distance of less than e.g. a few millimeters beside the electron beam impacting onto the target. For measuring the temperature of the hot area, the further electrode may preferably be placed about 0.2 mm above the hot area to provide a sufficiently high pull-field, preferably ca. 1 kV/mm, and to overcome space charge limitations.

Using a rotating target, a hot area or former focal spot area may signify the specific area of the face of the target which has been a focal spot straight before due to the direct exposure to the electron beam causing a heating of this area. Because of the rotation, the focal spot area of the target may be rotated out of the electron beam and a new area of the target may be rotated into the electron beam, such that this new area may represent the present focal spot.

However, the former focal spot area may still be at a very elevated temperature and thermally emitting electrons which may be detected by the further electrode.

The hot area, i.e. former focal spot area, and the present focal spot may be located in close neighbourhood on the target, which means that there may be a small spatial distance of e.g. a few millimeters, preferably less than 1 mm, between them.

According to an embodiment of the present invention, the further electrode is placed opposite to a focal track of the impacting electron beam.

Using a rotating target, the term "focal track" may signify the sum of all areas of the target onto which areas the electron beam impacts during regular operation of the X-ray tube. These areas may be located on a circular path on the face of the target centred around the rotation axis of the target.

The further electrode may be directed towards the face of the target, above the focal track. Preferably, the further electrode may be placed about 0.2 mm above the focal track.

According to an embodiment of the present invention, the further electrode is arranged at a position and in a distance to the focal spot such that, during operation of the X-ray tube, essentially no backscattered electrons emitted from the focal spot are captured by the further electrode.

Backscattered electrons emitted from the focal spot may distort the signal detected by the further electrode. Backscattered electrons cannot contribute information about the temperature of the target as the backscattering process is mainly dependent only on the energy of the electrons of the primary beam but not on the temperature of the target.

Therefore, to allow for a temperature measurement e.g. even during operation and not only during times of cooling, the further electrode may be shielded by distance and/or other means from backscattered electrons in order to avoid that the overall signal provided by the further electrode due to captured electrons is dominated or at least disturbed by undesired capturing of backscattered electrons. Accordingly, the signal provided by such shielded electrode may be mainly due to electrons from temperature-dependent thermo ionic emission and may therefore provide a low-noise temperature-indicating signal.

It may be desirable that only electrons emitted due to the thermo ionic effect are detected by the further electrode. Using various means for shielding the further electrode from backscattered electrons, it may be possible to reduce the amount of backscattered electrons detected by the further electrode. However, despite all shielding measures, a certain amount of backscattered electrons may still be detected by the further electrode and distort the signal. The term "capturing 'essentially' no backscattered electrons" may signify that the shielding against backscattered electron is such efficient that despite the presence of backscattered remaining electrons the actual signal due to capturing thermally emitted electrons may be clearly measured and a temperature of the target may be derived therefrom.

According to an embodiment of the present invention, the further electrode is shielded from backscattered electrons emitted from the focal spot by means of a scattered electron capturing device.

The scattered electron capturing device may have any desired shape comprising e.g. a wall for shielding against electrons. For example, the scattered electron capturing device may be a bell-shaped device which may be placed between e.g. the cathode and the target so that the underside of the bell may be in parallel to a plane, in which the target may rotate. The scattered electron capturing device may have a certain distance to the target so that a free rotation of the target may be possible. The bell-shaped device may comprise a passage along its longitudinal axis which may permit the electron beam to strike on the target unhamperedly.

Backscattered electrons emitted from the focal spot may be captured by the scattered electron capturing device.

The further electrode may be preferably arranged sidewards from the electron capturing device such that the electron capturing device is arranged between the focal spot and the further electrode. Alternatively, the further electrode may be arranged at a surface of the scattered electron capturing device itself which surface is arranged and oriented such that backscattered electrons may not get to the further electrode.

According to an embodiment of the present invention, the X-ray tube further comprises an analysing unit adapted for deriving a signal relating to a temperature of the target by utilizing a diode function established between the target and the further electrode.

A common function of a diode may be to allow an electric current to pass in one direction and to block the current in the opposite direction. The target may emit electrons. Due to the positive potential of the further electrode in relation to the target, the emitted electrons may be captured by the further electrode which means that a first electron flow from the target towards the further electrode may occur. This first electron flow may be measured. Depending on the temperature of the target, a higher or lower first electron flow may occur. Therefore, the first electron flow may represent an applicable signal relating to the temperature of the target.

In contrast thereto, if the target would have a neutral or positive potential in relation to the further electrode, an electron flow from the further electrode towards the target may usually not occur because the further electrode is usually not adapted to emit electrons. Nor may occur a flow of emitted electrons from the target towards the further electrode because the further electrode may not attract emitted electrons if the further electrode has a negative potential in relation to the target. In contrary, the negatively charged further electrode will repel approaching electrons such that even thermally emitted electrons flying in a direction towards the further electrode will usually not reach the further electrode.

Anyway, a second electron flow from the target towards the further electrode may be measured. This second electron flow may be based on e.g. recoil electrons, backscattered electrons or any other interfering electrons which may get to the further electrode despite of the relatively small electrical potential differences between the further electrode and the target. The kinetic energy of these electrons may be much larger than the energy of thermally emitted electrons, which are then accelerated by the positive potential, which is applied to the further electrode for temperature measurement. E.g. the kinetic energy of the recoil electrons may range up to 150 keV, whereas the thermally emitted and accelerated electrons may have max. 1 keV when the potential for temperature measurement is max. 1 keV.

Due to the described characteristics of permitting and disallowing different electron flows depending on the electrical potentials applied to the target and the further electrode, the combination of the target and the further electrode may act as a diode. This diode function may be used for providing a temperature-indicating signal which is mainly cleared from interfering influences due to backscattered electrons.

For this purpose, a first signal might be derived while setting the further electrode to a positive potential with respect to the target. The measured first electron flow is due to both, thermally emitted electrons and backscattered electrons. Then, a second signal might be derived while setting the further electrode to a negative potential with respect to the target. The measured second electron flow is then mainly due high-energy backscattered electrons. The measured first and second electron flow signals may be received by an analysing unit. The analyzing unit may be comprised inside the X-ray tube or may be arranged outside from the X-ray tube.

A final signal may be derived by subtracting the second signal from the first signal. The final signal may then mainly represent the flow of electrons due to thermo ionic emission without negative influence of backscattered electrons.

According to an embodiment of the present invention, the analysing unit is adapted for measuring a first electron flow when the further electrode is on positive potential with respect to the target; measuring a second electron flow when the further electrode is not on positive potential with respect to the target; and calculating a value based on the measured first and second electron flows.

In order to get a useful signal representing the temperature based on the flow of emitted electrons, it may be applicable to extract this signal from background signals, e.g. recoil electrons, backscattered electrons or any other interfering electrons.

Therefore, it may be applicable to calculate a value based on the measured first and second electron flow. Such a value may be e.g. the electron flow of the emitted electrons when the further electrode is on positive potential in relation to the target, without interferences caused by recoil electrons, backscattered electrons or any other interfering electrons. Such a value may be obtained by means of the analyzing unit, e.g. by building a difference between the first and the second electron flow by means of the analyzing unit.

According to an embodiment of the present invention, the X-ray tube is adapted to apply an alternating voltage between the target and the further electrode.

The electrical potential applied between the target and the further electrode may be an alternating voltage of e.g. several hundred volts. Such an alternating voltage applied at the target and the further electrode may effect that the further electrode is periodically on positive or negative electrical potential in relation to the target.

The further electrode may be on positive potential in relation to the target due to the positive half-wave of the alternating voltage applied to the target and the further electrode. Simultaneously, due to the thermo ionic effect, electrons may be emitted from the target and attracted by the further electrode. The first electron flow may be measured.

The further electrode may not be on positive potential in relation to the target due to the negative half-wave or the zero-crossing of the alternating voltage applied to the target and the further electrode may. Moreover, the further electrode may not be on positive potential in relation to the target if no alternating voltage may be applied to the target and the further electrode at all. Due to the absent positive potential of the further electrode, emitted electrons may not be captured by the further electrode. The second electron flow consisting of backscattered electrons, etc. may be measured.

The applied alternating voltage may allow a continuous measurement of a plurality of first and second electron flows. Thereby, continuous measurement of a temperature-related signal may be achieved.

According to an embodiment of the present invention, the X-ray tube further comprises a controlling unit for controlling a voltage applied between the target and the further electrode wherein the controlling unit is arranged remote from the further electrode.

The controlling unit may control e.g. at what time the target and the further electrode may present which potential. Moreover, the controlling unit may control the frequency, the voltage, the current and other characteristics of the alternating voltage.

Preferably, the controlling unit may be arranged outside and in a certain distance from the X-ray tube, e.g. in a distance of several meters. Such a remote arrangement may provide a voltage shielding and may help to avoid voltage fluctuations inside or near the X-ray tube in order to safeguard the electronic parts of the controlling unit in case of tube arcing.

According to an embodiment of the present invention, a plurality of further electrodes is placed along a focal track on the target for measuring an azimuthal temperature profile.

The thermal gradient of the target may vary. Therefore, more than one further electrode may be arranged along the focal track for measuring its azimuthal temperature profile. From the set of signals received by the further electrodes the focal spot temperature and the temperature of the focal track may be calculated. A thermal computer model can be calibrated with real data.

According to a second aspect of the present invention, a medical device is provided, the medical device comprising an X-ray tube according to the first aspect of the invention and a temperature evaluation unit connected to the X-ray tube.

The temperature evaluation unit may be adapted to further process the signal representing the temperature or to effect subsequent procedures due to that signal. For example, the temperature evaluation unit may visualize the measured temperature of the target. Alternatively, the temperature evaluation unit may send controlling signals, e.g. for adapting the function of the X-ray tube depending on the measured target temperature. The temperature evaluation unit may effect starting, stopping or restarting the generation of X-rays, as well as changing tube parameters, like e.g. tube voltage, tube current, rotating velocity of the anode/target, etc.

The sending of controlling signals may depend on certain threshold values of the measured target temperature, e.g. the power of the X-ray tube may be reduced if the measured temperature of the target may exceed a certain threshold value.

In this way, an increasing temperature of the target and the X-ray tube may be prohibited, the target and the X-ray tube may be allowed to cool down or a constant temperature of the target and the X-ray tube may be guaranteed.

The medical device may be a conventional X-ray apparatus, a computed tomography system or any other apparatus, system or device requiring an X-ray tube.

According to a third aspect of the present invention, a program element is provided, wherein the program element is adapted for measuring a temperature of a target in an X-ray tube according to the first aspect of the invention, wherein the program element, when being executed by a processor, causes the processor to carry out the steps of controlling an alternating electrical potential between the target and the further electrode; measuring a first electron flow when the further electrode is on positive potential with respect to the target; measuring a second electron flow when the further electrode is not on positive potential with respect to the target; and calculating a value based on the measured first and second electron flow.

The program element may preferably be loaded into a working memory of a processor. The processor is thus equipped to control a temperature measurement of a target in an X-ray tube according to the first aspect of the invention.

According to a forth aspect of the present invention, a computer readable medium is provided, on which a program element according to the third aspect of the invention is stored.

The computer readable medium may be e.g. a CD-ROM or be presented over a network like the worldwide web and can be downloaded into a working memory of a processor from such a network.

It has to be noted that aspects, embodiments and features of the invention have been described with reference to different subject-matters. In particular, some features and embodiments have been described with reference to the X-ray tube itself whereas other features and embodiments have been described with respect to its operation or use. However, a person skilled in the art will gather from the above and the following description that, unless other notified, in addition to any combination or features belonging to one type of subject-matter also any combination between features relating to different subject-matters is considered to be disclosed with this application.

The aspects defined above and further aspects, features and advantages of the present invention can also be derived from the examples of embodiments to be described hereinafter and are explained with reference to examples of embodiments. The invention will be described in more detail hereinafter with reference to examples of embodiments but to which the invention is not limited.

BRIEF DESCRIPTION OF THE DRAWINGS

It is to be noted that the drawings are only schematic and not to scale. Furthermore, similar reference signs designate similar elements throughout the drawings.

DETAILED DESCRIPTION OF EMBODIMENTS

Figure 1:
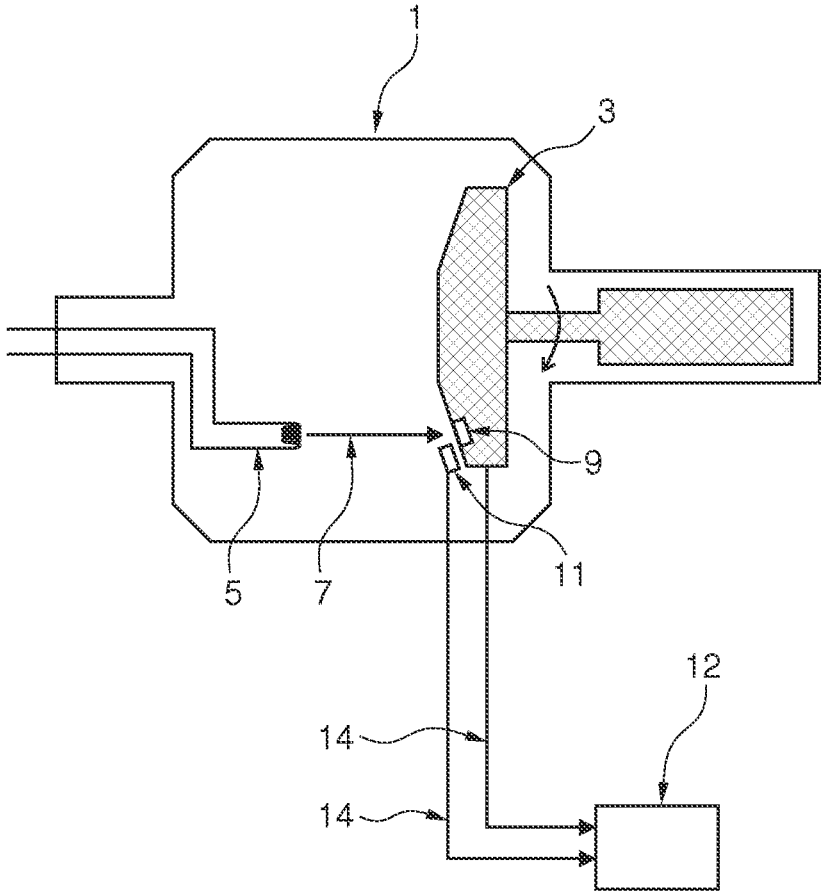
FIG. 1 shows a schematic representation of an X-ray tube according to an embodiment of the invention.

FIG. 1 shows a schematic representation of an X-ray tube according to an embodiment of the invention.

A hot cathode 5 generates electrons which are accelerated towards a target 3. The electrons may be accelerated due to an electrical potential difference between the hot cathode and the target. The anode and the target may be separated or, as illustrated, one and the same device. The target is rotating. The plurality of accelerated electrons represents an electron beam 7. The electron beam impacts onto the target at the focal spot 9.

Due to the interaction of the electrons with the target material, X-rays are generated. Moreover, the target material is warmed up and further electrons may be emitted from the target due to the effect of thermo ionic electron emission.

The electrons emitted from the target are detected by a further electrode 11.

A backscattered electron capturing device may be arranged near the surface of the target (not illustrated in FIG. 1).

The X-ray tube may comprise an analyzing unit 12, which can be placed inside the X-ray tube or, as illustrated, outside the X-ray tube. Inside the X-ray tube, a signal relating to temperature can be generated and transferred to the analyzing unit via lines 14 in order to be then processed in the analyzing unit 12.

The X-ray tube 1 may be an anode grounded tube.

Figure 2:
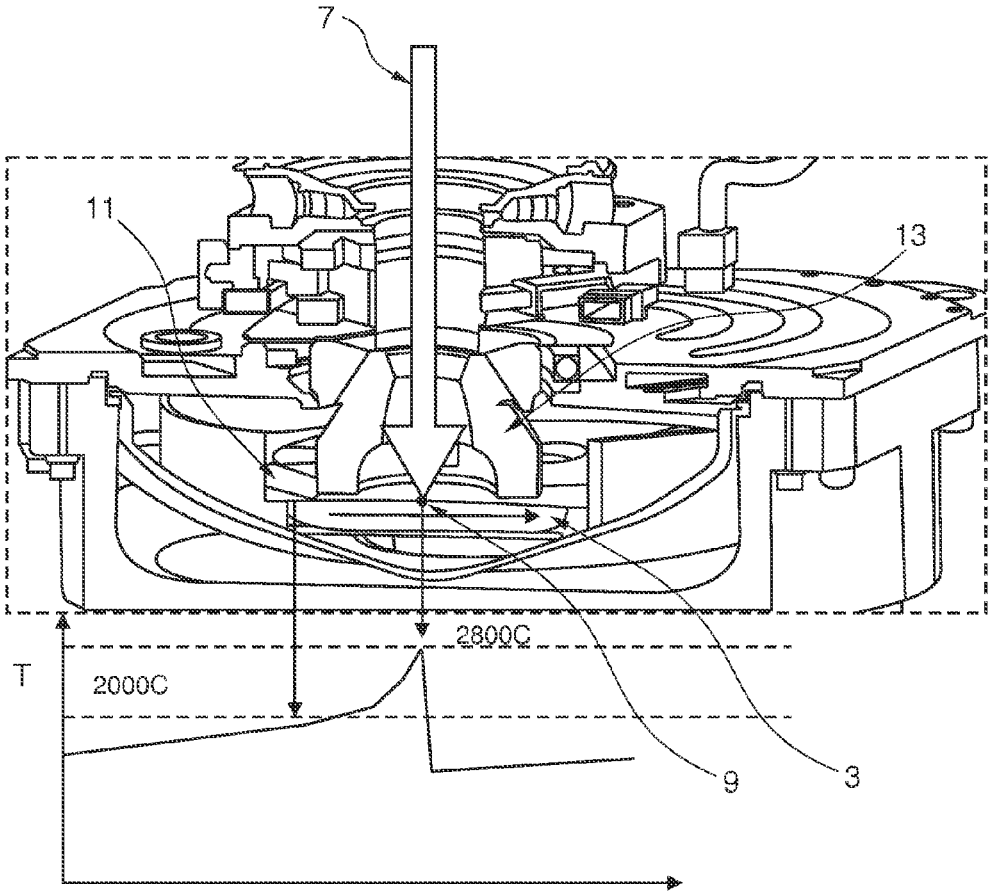
FIG. 2 shows a detailed schematic representation of the target area of an X-ray tube according to an embodiment of the invention in combination with a diagram of the spread of the target temperature.

FIG. 2 shows a detailed schematic representation of the target area of an X-ray tube according to an embodiment of the invention in combination with a diagram of the distribution of the target temperature.

The electron beam 7 impacts on the target 3 at the focal spot 9.

The abscissa of the diagram represents the respective target area. The ordinate represents the temperature at the respective target area.

As illustrated in the diagram, the temperature at the focal spot may amount to about 3000° C.

The further electrode for detecting the electrons emitted from the target due to the effect of thermo ionic electron emission is located in a certain distance from the focal spot. There, the temperature at of the target may amount to about 1900° C.

This means that electrons emitted from an area close to the focal spot of the target are detected.

Beside the electrons emitted from the target due to the effect of thermo ionic electron emission, recoil electrons or backscattered electrons may be emitted from the target. Such backscattered electrons may distort the signal detected by the further electrode.

Therefore, the further electrode is shielded by a scattered electron capturing device 13. As illustrated, the scattered electron capturing device is a bell-shaped device which is placed in parallel to the electron beam and near the surface of the target so that the underside of the bell may be in parallel to the plane, in which the target rotates. The scattered electron capturing device has a certain distance to the target so that a free rotation of the target is possible. The bell-shaped device comprises a passage along its length axis which permits the electron beam to strike on the target unhamperedly.

As illustrated, the further electrode 11 is arranged sidewards of the electron capturing device 13.

The scattered electron capturing device 13 may have any other applicable form.

Figure 3:
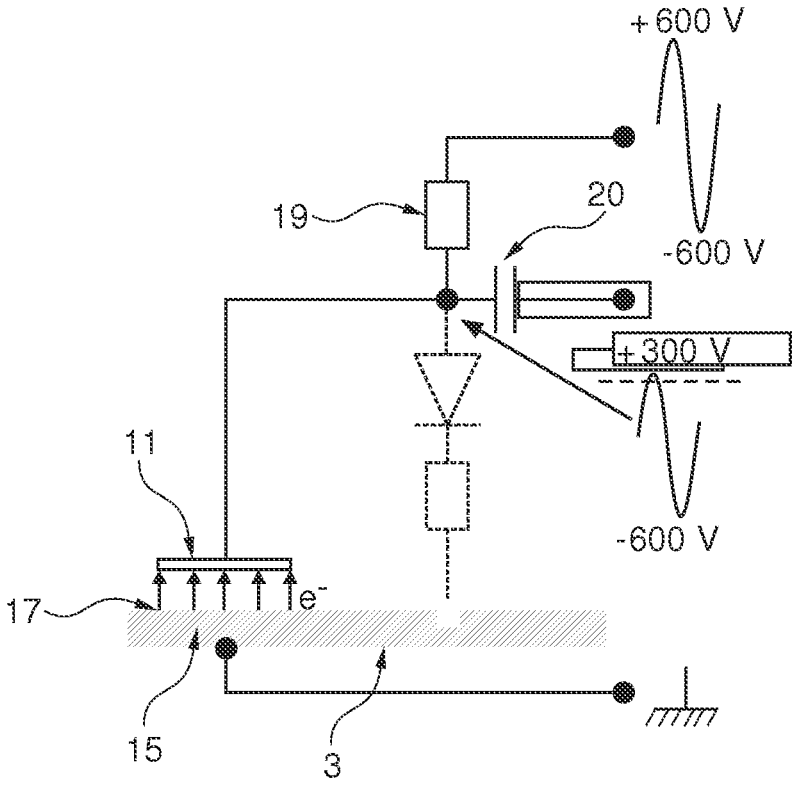
FIG. 3 shows a schematic representation of the diode function of an X-ray tube according to an embodiment of the invention.

FIG. 3 shows a schematic representation of the diode function of an X-ray tube according to an embodiment of the invention.

Due to the impact of the electron beam onto the target 3 and accordingly heating of the target, the target is emitting electrons 17 due to the effect of thermo ionic electron emission along a focal track 15 while the target is rotating.

When the further electrode 11 is on positive potential in relation to the target 3, the emitted electrons are captured by the further electrode 11 and an electron flow from the target 3 towards the further electrode 11 can be measured.

When the further electrode 11 is not on positive potential, the target has a more positive potential in relation to the further electrode so that the emitted electrons are attracted towards the target. Since the further electrode for its part is not adapted to emit electrons due to the thermo ionic effect, an electron flow from the further electrode 11 towards the target 3 does not occur.

An alternating voltage with an amplitude of −600 to +600 volts is applied to a resistor 19. By means of the resistor 19, an alternating voltage with an amplitude of e.g. −600 to +300 volts is applied to the further electrode 11. In case of the absence of recoil electrons, in the negative phase, the current through resistor 19 is essentially zero, in the positive phase the voltage across resistor 19 represents the thermally induced electron current which flows through the further electrode 11 and reduces the positive voltage from 600 V to only 300 V.

If recoil electrons add (the current of which is essentially independent on the voltage at the further electrode 11, as the recoil electrons impinge with a very high kinetic energy, and a small repelling field during the negative phase does hardly hamper them from reaching the further electrode), a constant current of recoil electrons is superimposed to an alternating current of thermally induced electrons. The capacitor 20 separates and delivers to the further measurement electronics just the alternating voltage change across resistor 19 which represents the alternating part of the current through the further electrode 11, which in turn represents the thermally induced signal to be measured. The constant current of recoil electrons is electronically suppressed by the capacitor.

Figure 4:
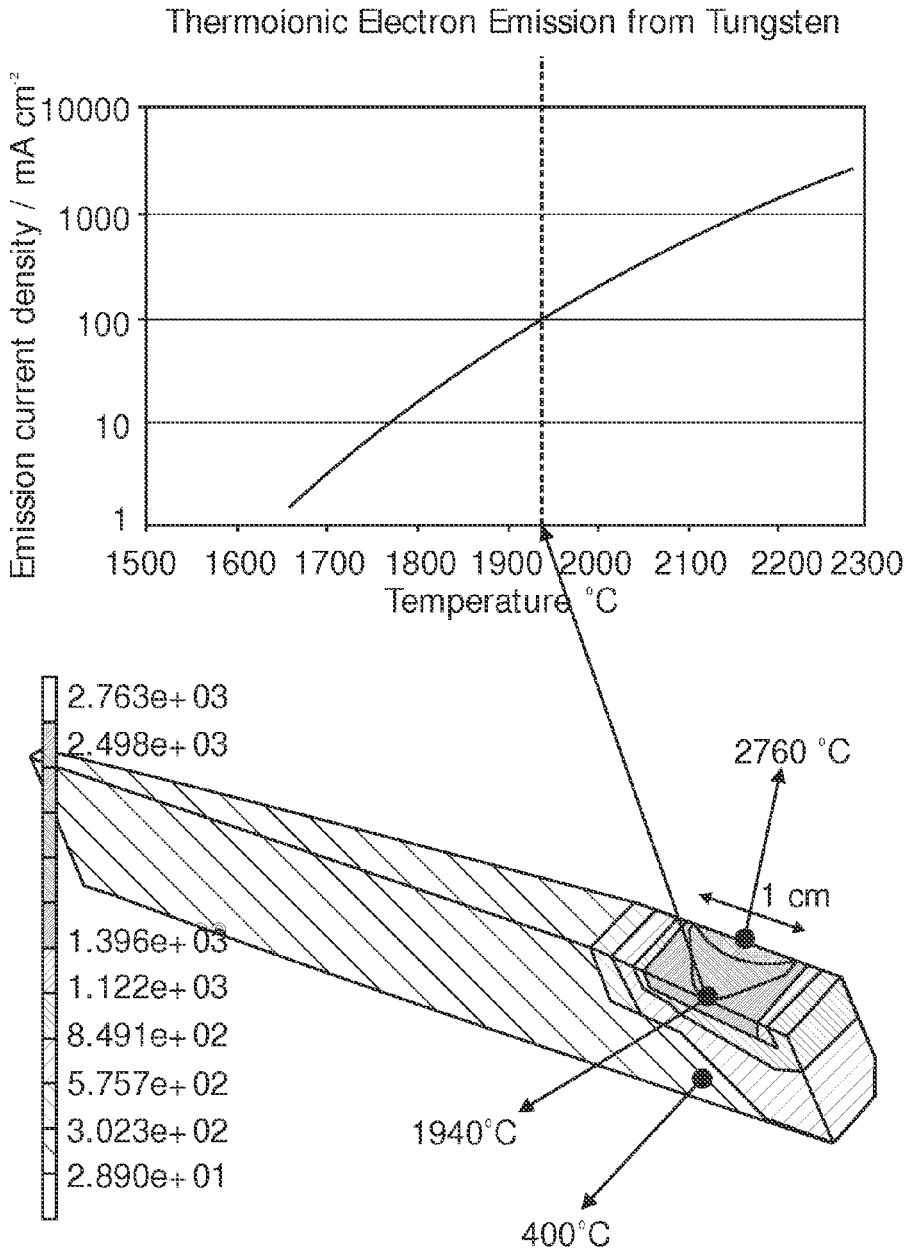
FIG. 4 shows a schematic representation of a segment of the target of an X-ray tube according to an embodiment of the invention in combination with a diagram of the spread of the temperature in this segment.

FIG. 4 shows a schematic segment of the target of an X-ray tube according to an embodiment of the invention in combination with a diagram of the distribution of the temperature in this segment.

The segment of the target illustrates the different temperatures that can be measured at the focal spot of a tungsten target and at different distances from the focal spot. At the focal spot, the surface temperature amounts to 2760° C., wherein in a deeper layer of the target, the temperature merely amounts to 400° C.

The diagram illustrates the electron emission density in dependence on different temperatures of a tungsten target. For example, at a surface area close to the focal spot, the temperature amounts to 1940° C. At this surface area presenting a temperature of 1940° C., an emission current density of about 100 mA/cm$^2$ can be found.

This emission current density can be detected by means of the further electrode 11.

Figure 5:
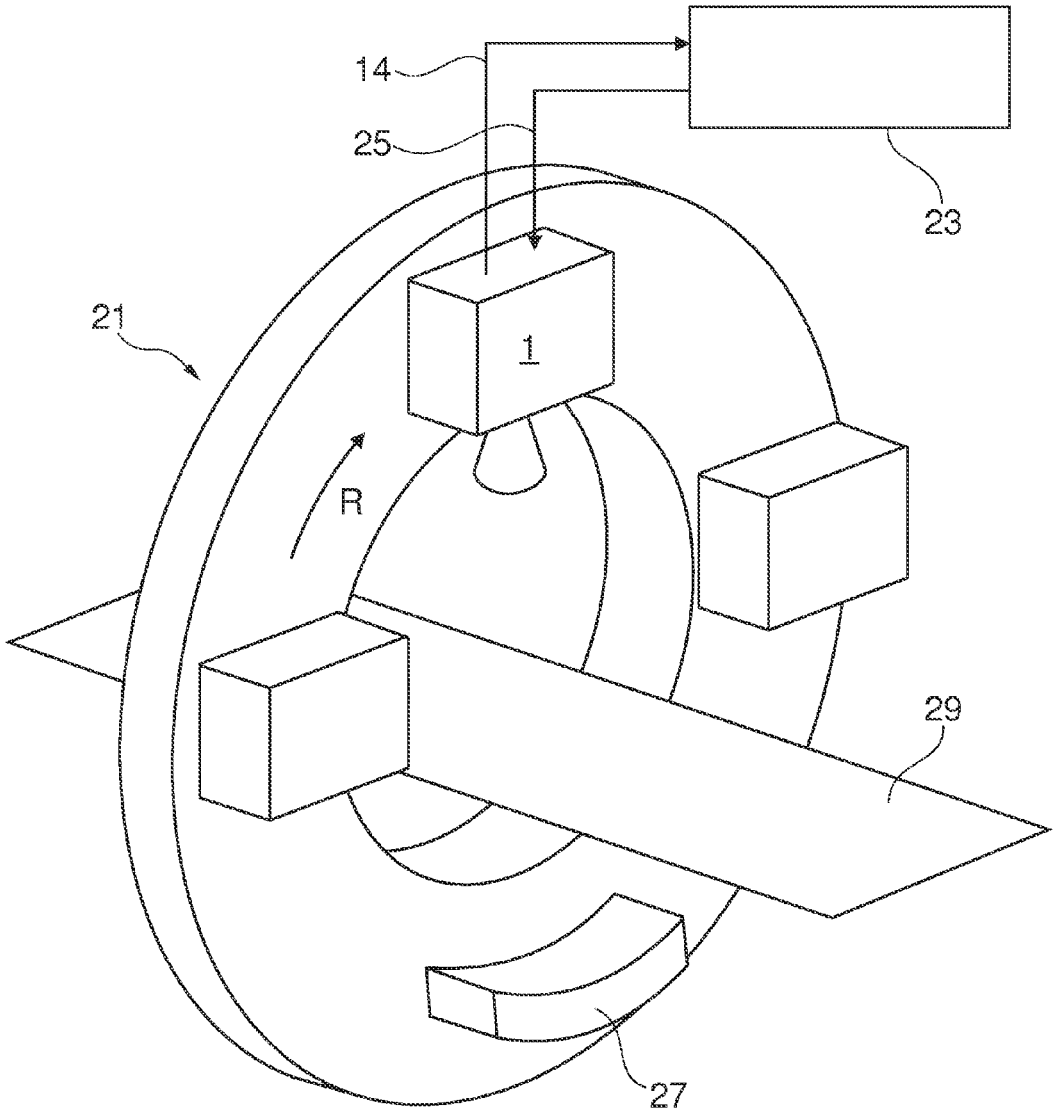
FIG. 5 shows an example for a medical device and associated signal paths according to the invention.

FIG. 5 shows an example for a medical device and associated signal paths incorporating an X-ray tube according to an embodiment of the invention.

The medical device may be a CT scanner 21, comprising an X-ray tube 1, a radiation detector 27, a patient table 29 and a temperature evaluation unit 23. The CT scanner may rotate around the object to be observed and may acquire projection images by means of radiation detection using the detector 27. An X-ray tube 1 as described above according to the invention can be used to measure the temperature of the target. The temperature evaluation unit 23 is connected to the X-ray tube 1 via line 14 and can be located inside the X-ray tube or outside from the X-ray tube.

The temperature evaluation unit 23 may be adapted to further process a signal representing the temperature of the target or to effect subsequent procedures due to that signal.

The temperature evaluation unit may send controlling signals via line 25 to the X-ray tube, e.g. for adapting the function of the X-ray tube depending on the measured target temperature.

It should be noted that the term "comprising" does not exclude other elements or steps and the "a" or "an" does not exclude a plurality. Also elements described in association with different embodiments may be combined. It should also be noted that reference signs in the claims should not be construed as limiting the scope of the claims.

LIST OF REFERENCE SIGNS

1 X-ray tube
3 target
5 hot cathode
7 electron beam
9 focal spot
11 further electrode
12 analyzing unit
13 backscattered electron capturing device
14 line for transmitting signal relating to temperature
15 focal track of the anode
17 thermo ionic electron emission
19 resistor
20 capacitor

21 CT scanner
23 temperature evaluation unit
25 line for transmitting controlling signals
27 radiation detector
29 patient table

The invention claimed is:

1. An X-ray tube comprising:

a target adapted for generating X-rays upon impact of an electron beam on a focal spot; and a further electrode, wherein the further electrode is arranged and adapted for measuring thermo ionic electron emission from the target, and the further electrode is arranged at a position and in a distance to the focal spot such that, during operation of the X-ray tube, essentially no backscattered electrons emitted from the focal spot are captured by the further electrode.

2. The X-ray tube according to claim 1, wherein the X-ray tube is adapted for providing a signal relating to a temperature of the target based on thermo ionic electron emission measured by the further electrode.

3. The X-ray tube according to claim 1, wherein the further electrode is at least part time on positive electrical potential with respect to an electrical potential of the target.

4. The X-ray tube according to claim 1, wherein the further electrode is arranged at a position and in a distance to the target such that, during operation of the X-ray tube and the further electrode having a positive potential with respect to an electrical potential of the target, the further electrode captures electrons emitted from a hot area in a neighborhood of the focal spot.

5. The X-ray tube according to claim 1, wherein the further electrode is placed opposite to a focal track of the impacting electron beam.

6. The X-ray tube according to claim 1, wherein the further electrode is shielded from backscattered electrons emitted from the focal spot by means of a scattered electron capturing device.

7. The X-ray tube according to claim 1, wherein the X-ray tube is adapted to apply an alternating voltage between the target and the further electrode.

8. The X-ray tube according to claim 1, further comprising a controlling unit for controlling a voltage applied between the target and the further electrode wherein the controlling unit is arranged remote from the further electrode.

9. A medical device comprising:

an X-ray tube according to claim 1;

a temperature evaluation unit connected to the X-ray tube.

10. An X-ray tube comprising:

a target adapted for generating X-rays upon impact of an electron beam on a focal spot;

a further electrode arranged and adapted for measuring thermo ionic electron emission from the target; and an analyzing unit adapted for deriving a signal relating to a temperature of the target by utilizing a diode function established between the target and the further electrode.

11. An X-ray tube comprising:

a target adapted for generating X-rays upon impact of an electron beam on a focal spot;

a further electrode arranged and adapted for measuring thermo ionic electron emission from the target; and an analyzing unit adapted for deriving a signal relating to a temperature of the target by measuring a first electron flow when the further electrode is on positive potential with respect to the target, measuring a second electron flow when the further electrode is not on positive potential with respect to the target, and calculating a value based on the measured first and second electron flow.

12. The X-ray tube according to claim 11, wherein the analyzing unit is adapted for calculating the value by subtracting the second electron flow from the first electron flow.

13. An X-ray tube comprising:

a target adapted for generating X-rays upon impact of an electron beam on a focal spot; and a further electrode;

wherein the further electrode is arranged and adapted for measuring thermo ionic electron emission from the target, and a plurality of further electrodes is placed along a focal track on the target for measuring an azimuthal temperature profile.

14. A non-transitory computer readable medium storing a program for measuring a temperature of a target in an X-ray tube having a further electrode arranged and adapted for measuring thermo ionic electron emission from the target, the program when executed by a processor, causing the processor to perform acts of:

controlling an alternating electrical potential between the target and the further electrode;

measuring a first electron flow when the further electrode is on positive potential with respect to the target;

measuring a second electron flow when the further electrode is not on positive potential with respect to the target; and calculating a value based on the measured first and second electron flow.

15. The computer readable medium on which a program according to claim 14 is stored, wherein the act of calculating the value comprises an act of subtracting the second electron flow from the first electron flow.

* * * * *